US011644194B2

(12) United States Patent
Irons

(10) Patent No.: US 11,644,194 B2
(45) Date of Patent: May 9, 2023

(54) LINEAR OPTICAL SYSTEM WITH INGRESS PROTECTION

(71) Applicant: Elemental LED, Inc., Reno, NV (US)

(72) Inventor: Travis Irons, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/741,644

(22) Filed: May 11, 2022

(65) Prior Publication Data

US 2022/0364717 A1 Nov. 17, 2022

Related U.S. Application Data

(60) Provisional application No. 63/187,659, filed on May 12, 2021.

(51) Int. Cl.

| | |
|---|---|
| ***F21V 31/00*** | (2006.01) |
| ***F21S 4/28*** | (2016.01) |
| ***F21Y 103/10*** | (2016.01) |
| ***F21Y 115/10*** | (2016.01) |

(52) U.S. Cl.
CPC ..... *F21V 31/005* (2013.01); *F21S 4/28* (2016.01); *F21Y 2103/10* (2016.08); *F21Y 2115/10* (2016.08)

(58) Field of Classification Search
CPC ..... F21S 4/28; F21S 2/005; F21V 31/005; F21V 5/008
See application file for complete search history.

(56) References Cited

U.S. PATENT DOCUMENTS

| | | | | |
|---|---|---|---|---|
| 9,279,544 | B1 | 3/2016 | Dankelmann et al. | |
| 10,788,170 | B1 | 9/2020 | Bryan | |
| 11,168,852 | B1 | 11/2021 | Irons et al. | |
| 2007/0223218 | A1* | 9/2007 | You | F21V 15/015 362/231 |
| 2011/0280010 | A1* | 11/2011 | Ou | F21K 9/27 362/217.02 |
| 2016/0377257 | A1* | 12/2016 | Xu | F21V 5/08 362/224 |
| 2022/0049840 | A1* | 2/2022 | Klus | F21V 15/013 |
| 2022/0228723 | A1* | 7/2022 | Bryan | G02B 27/0012 |

OTHER PUBLICATIONS

U.S. Appl. No. 17/230,081, filed Apr. 14, 2021.

* cited by examiner

*Primary Examiner* — William N Harris
(74) *Attorney, Agent, or Firm* — United IP Counselors, LLC

(57) ABSTRACT

A linear luminaire having high ingress protection includes a light-generating assembly and a channel. The light-generating assembly is an elongate, self-contained, sealed optical assembly that includes all elements necessary to generate light and to direct, focus, or modify the generated light in a particular way. Typically, the light-generating assembly would include an outer optical element and a light source positioned within a cavity of the body of the light-generating assembly. The outer optical element may be a lens, diffuser, or other such element. The light source may be a strip of LED linear lighting, a string of connected LED modules, or any other suitable device. The light-generating assembly may optionally include a second optical element, such as a lens or diffuser, that is supported within the body. The ends of the body of the light-generating assembly may be sealed by fitted endcaps, by polymeric resin, or by other means.

15 Claims, 8 Drawing Sheets

LINEAR OPTICAL SYSTEM WITH INGRESS PROTECTION

CROSS-REFERENCE TO RELATED APPLICATIONS

This application claims priority to, and the benefit of, U.S. Provisional Patent Application No. 63/187,659, filed May 12, 2021, the contents of which are incorporated by reference herein in their entirety.

TECHNICAL FIELD

This invention relates to optical systems for linear lighting.

BACKGROUND

Linear lighting is a particular type of solid-state lighting. In this type of lighting, a long, narrow printed circuit board (PCB) is populated with light-emitting diode (LED) light engines, usually spaced at a regular pitch or spacing. Each LED light engine contains one or more LEDs along with the wires, structures, and connections necessary to mount the LEDs on the PCB. The PCB may be either rigid or flexible, and other circuit components may be included on the PCB, if necessary. Depending on the type of LED light engine or engines that are used, the linear lighting may emit a single color, or may be capable of emitting multiple colors.

In combination with an appropriate power supply or driver, linear lighting is considered to be a luminaire in its own right, and it is also used as a raw material for the production of more complex luminaires, such as light-guide panels.

One of the most popular ways of using linear lighting is to install it in a channel and cover it with a cover. The cover typically acts as a diffuser, spreading the light and improving the overall appearance of the emitted light. Examples of channels used with linear lighting can be found in U.S. Pat. No. 9,279,544, the contents of which are incorporated by reference in their entirety. The typical channel for linear lighting is a single-piece extrusion, made of metal or plastic, that has a pair of sidewalls and a bottom.

In a variation on the usual channel-and-cover arrangement, U.S. Pat. No. 10,788,170 to Bryan, the contents of which are incorporated by reference herein in their entirety, discloses two-element optical systems for linear lighting. These systems are designed to provide a highly focused or evenly diffused light beam and can be used in a channel even when the channel is only designed for a single cover or element.

In the systems of U.S. Pat. No. 10,788,170, the outer lens of the two-element system also serves as a cover. The cover is a physical barrier to limit ingress of dust into the channel. However, the protection provided by a typical linear lighting channel cover is limited. While greater protection against the ingress of water and other types of foreign material is often desirable, designing channels, covers, and other elements that can provide that protection can be particularly difficult, especially when the luminaire has multiple parts.

BRIEF SUMMARY

One aspect of the invention relates to closed optical assembly. The optical assembly includes a hollow outer optical element, an inner optical element, and a strip of linear lighting. The inner optical element and the strip of linear lighting are installed in a cavity of the outer optical element. Ends of the hollow outer optical element are closed, such as by endcaps, to seal the cavity of the outer optical element, thus protecting the optical assembly from ingress of dust, water, or other foreign material.

In another aspect of the invention, the strip of linear lighting rests on an interior bottom of the cavity. The inner optical element rests on support structure in the cavity of the hollow outer optical element such that the inner optical element receives light emitted from the strip of linear lighting. The outer optical element supports the inner optical element such that the outer optical element is optically aligned with the inner optical element so as to receive light passed through the inner optical element.

A further aspect of the invention relates to a linear luminaire. The luminaire includes a channel and a closed optical assembly having a hollow outer optical element, an inner optical element, and a strip of linear lighting. Ends of the outer optical element are closed, such as by end caps, with the inner optical element and the strip of linear lighting encased in a cavity of the outer optical element. The outer optical element includes channel engaging structure that secures the outer optical element to the channel.

In another aspect, the channel includes mounting structure for the luminaire. The mounting structure may include hanging structure to suspend the luminaire from a surface as a hanging fixture.

Yet another aspect of the invention relates to a method for sealing the ends of an optical assembly, such as the optical assembly described above. In this method, an end of the optical assembly is dipped into a container that contains an uncured resin. The resin covers the end of the optical assembly and then is caused or allowed to cure.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
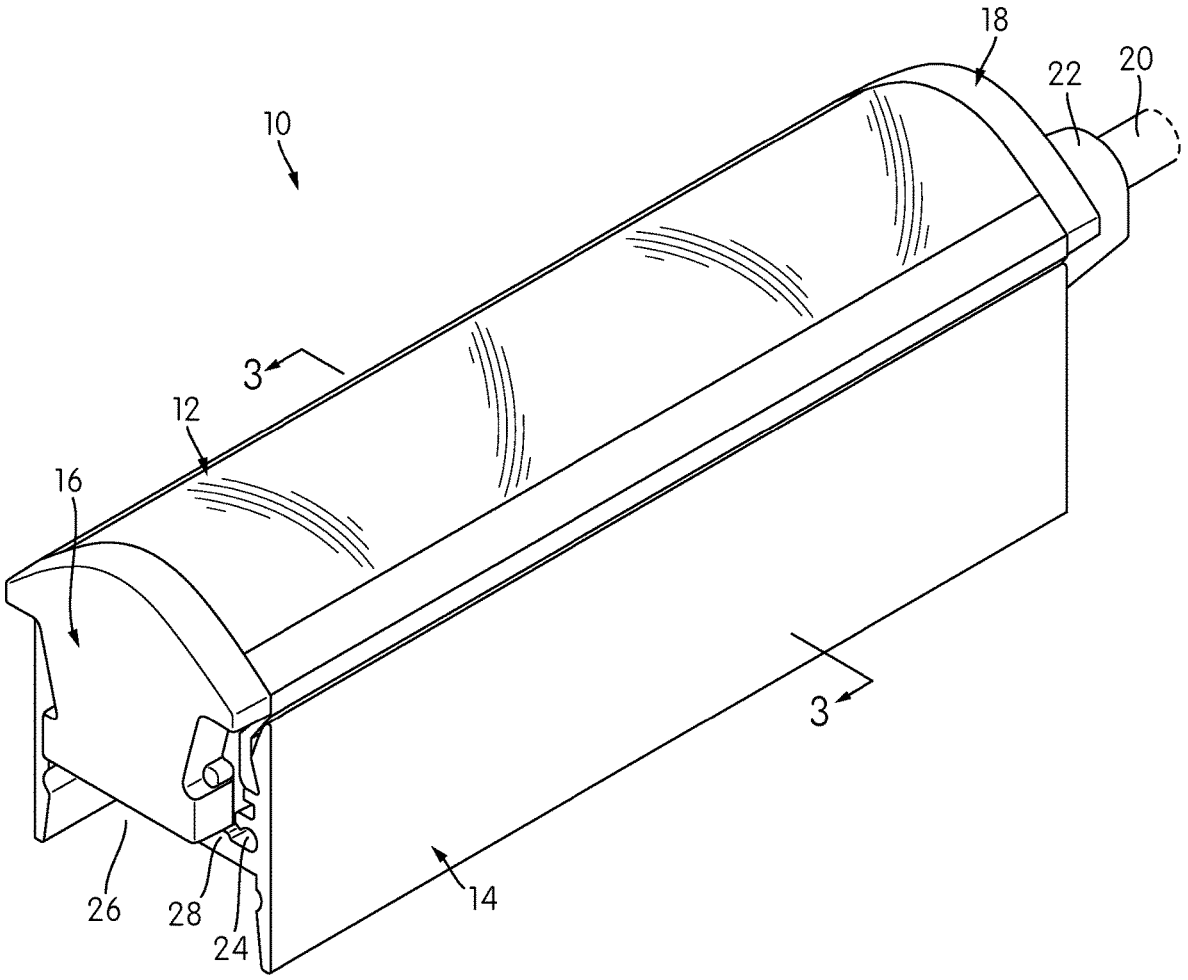
FIG. 1 is a perspective view of a linear luminaire according to one embodiment of the invention.

FIG. 1 is a perspective view of a linear luminaire, generally indicated at 10, according to one embodiment of the invention. The linear luminaire 10 includes a light-generating assembly 12 and a channel 14.

The light-generating assembly 12 is a self-contained, sealed optical assembly that includes all elements necessary to generate light and to direct, focus, or modify the generated light in a particular way. As will be described below in more detail, the light-generating assembly 12 would typically include at least one light source and at least one optical element. Here, the term "optical element" refers to an element that receives light from the strip of linear lighting and modifies that light in some way, e.g., to focus, direct, or diffuse the light. An optical element may be a lens, but the term broadly encompasses both lens and non-lens elements. A diffuser, a non-lens that diffuses or scatters the light, is one example of a non-lens element. Other examples of non-lens optical elements may include gels or filters that change the color of the light.

The light-generating assembly 12 is similar in capabilities to the two-element optical systems disclosed in U.S. Pat. No. 10,788,170 ("the '170 patent"). However, as will be explained below in more detail, in contrast to the systems of the '170 patent, the light-generating assembly 12 is intended to have a higher ingress protection rating. The light-generating assembly 12 may have an ingress protection rating of at least IP64, and it may have an ingress protection rating as high as IP67 or IP68. In other words, the light-generating assembly 12 will typically prevent ingress of dust, and will usually at least protect against splashes of water, although it may protect against water jets, and in some cases, may allow full immersion, or even continuous operation underwater.

To that end, in the embodiment of FIG. 1, the light-generating assembly is sealed by an endcap 16, 18 on each end. The endcap 16 on one end is solid; the other endcap has an opening (not shown in FIG. 1) that allows for the egress of a power cord 20 to power the lighting element inside. A molded strain relief 22 is fitted around the power cord 20 proximate to the endcap 18.

The channel 14 of FIG. 1 is the channel disclosed in U.S. Pat. No. 11,168,852, the contents of which are incorporated by reference herein in their entirety. This particular channel 14 has an upper compartment 24 in which the light-generating assembly 12 is seated, a lower compartment 26 that is adapted to accept mounting structures and also serves as a raceway for wires and cables, and a cross-member 28 that separates the upper compartment 24 from the lower compartment 26, giving the channel 14 an H-shaped cross-section. As will be described below in more detail, the light-generating assembly 12 and the channel 14 have complementary engaging features such that the light-generating assembly 12 snaps into place in the upper compartment 24 of the channel 14 without the use of tools, and without the need for dedicated fasteners or adhesives.

The channel 14 itself may, e.g., be made of a metal, such as aluminum, and may be extruded or machined. The basic form of the channel may be painted, powder-coated, anodized, or otherwise surface-treated as desired. Yet as those of skill in the art may realize, the particular features of the channel 14 are not critical to the invention. Rather, the light-generating assembly 12 may be adapted for placement in any type of channel. Moreover, while it is convenient if the channel 14 and the light-generating assembly 12 have complementary interengaging features and can "snap" together without the need for fasteners or adhesives, that may not always be the case. So long as the light-generating assembly 12 fits at least partially within a channel, adhesives or fasteners can be used to secure it.

Figure 2:
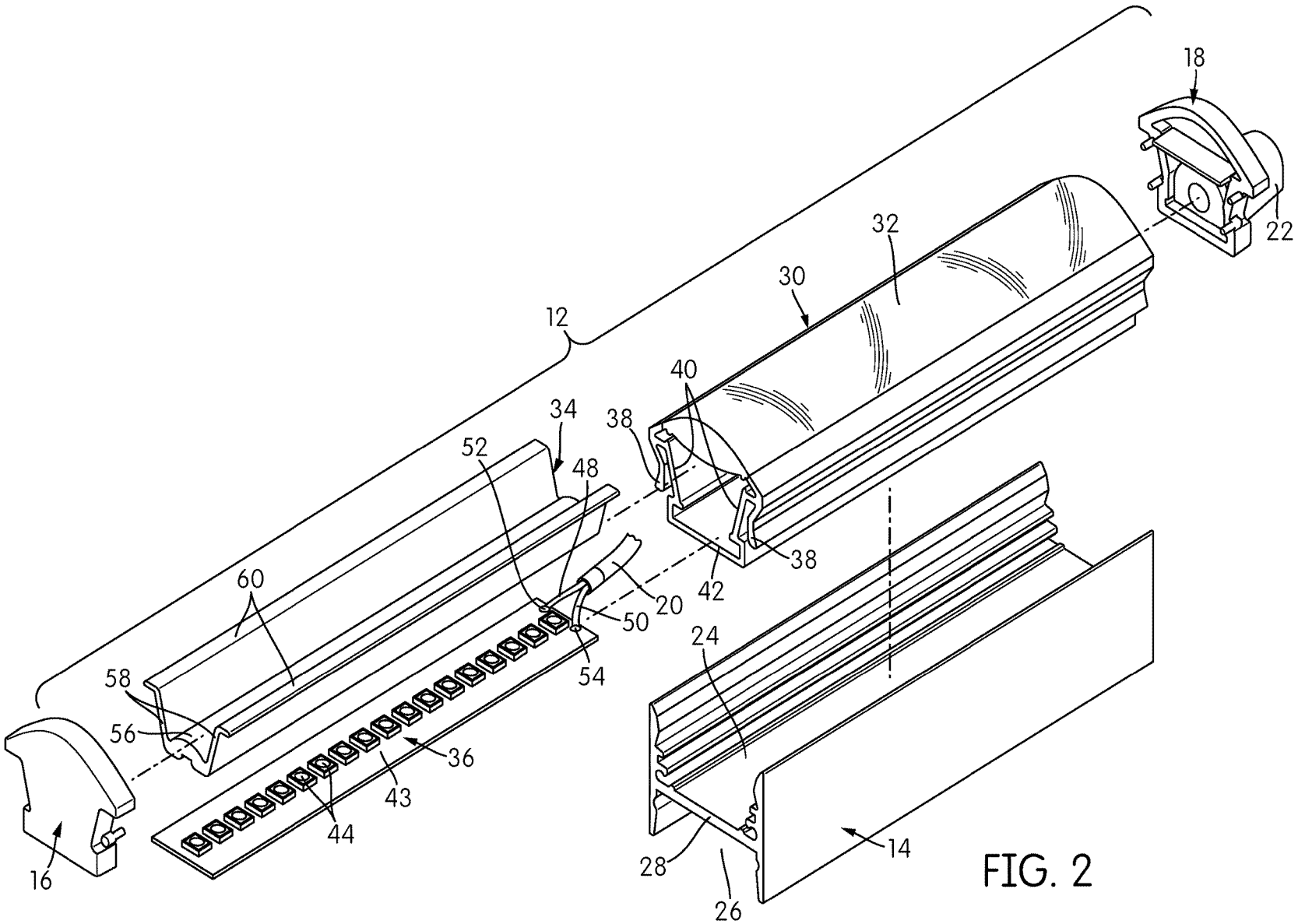
FIG. 2 is an exploded view of the linear luminaire of FIG. 1.
Figure 3:
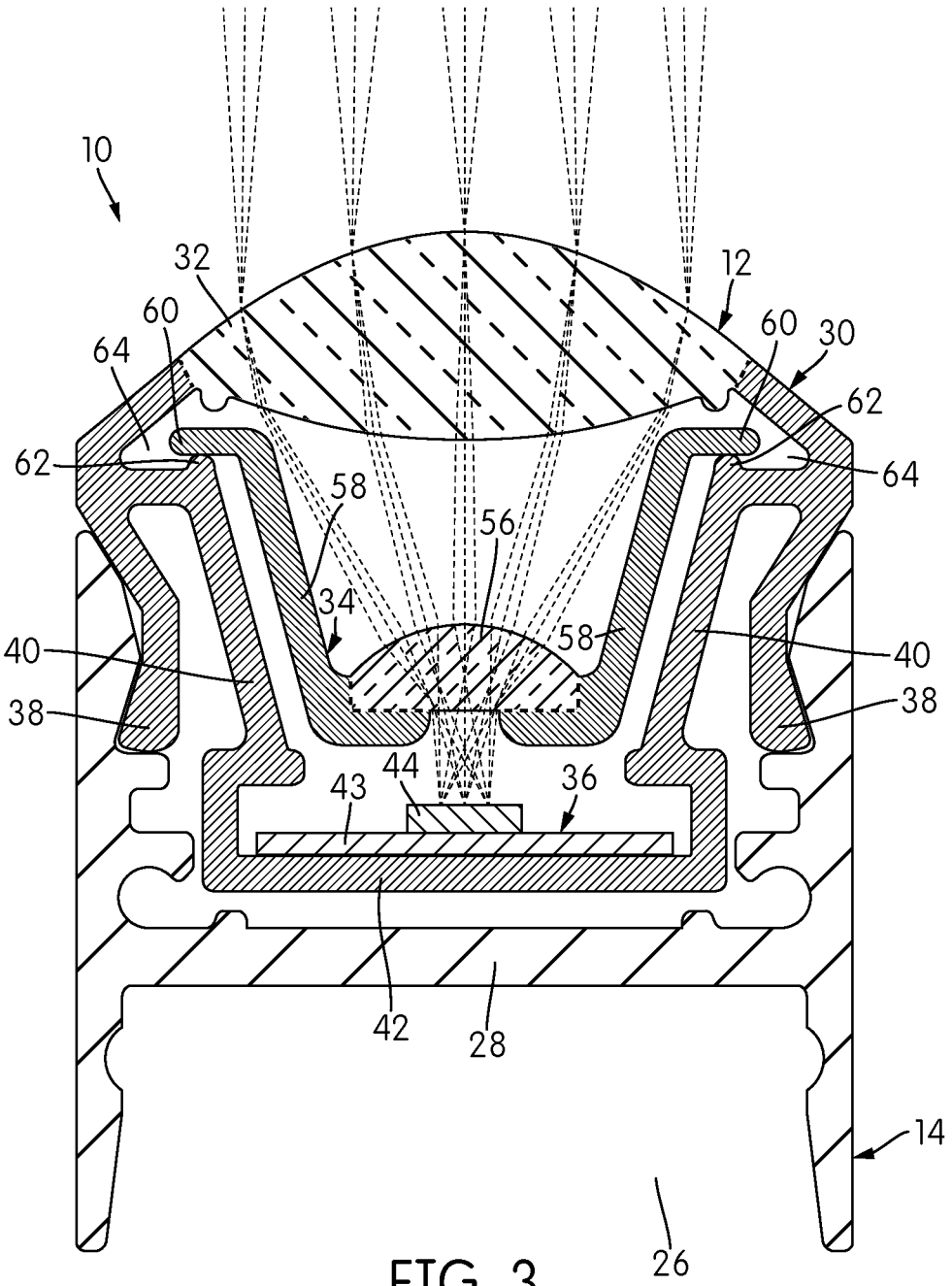
FIG. 3 is a cross-section taken through Line 3-3 of FIG. 1.

FIG. 2 is an exploded perspective view of the linear luminaire 10, and FIG. 3 is a cross-sectional view taken through Line 3-3 of FIG. 1. As shown in FIG. 2, the light-generating assembly 12 of this embodiment includes five major components: a body 30, which includes a first, outer optical element 32; a second, inner optical element 34; a light source 36, and the two endcaps 16, 18.

The body 30 of the light-generating assembly 12 has the general form of a hollow tube with an internal cavity. The outer optical element 32 lies at the top of the body 30 and, in this embodiment, is a biconvex lens of the type described in the '170 patent. In other embodiments, the outer optical element 32 could be a biconvex lens with a different curvature or curvatures, a different type of lens (e.g., convex, concave, biconcave, etc.), or a non-lens optical element, like a diffuser. In addition to a traditional lens, the outer optical element 32 may comprise a plurality of different facets, as in a Fresnel lens. The outer optical element 32 may also have features of the asymmetrical optical system of U.S. patent application Ser. No. 17/230,081, filed Apr. 14, 2021, the contents of which are incorporated by reference in their entirety.

From the outer optical element 32 down, the profile of the body 30 bifurcates, as can be seen at the end in FIG. 2 and in the cross-sectional view of FIG. 3. That bifurcation defines a set of mirror-image left and right connecting legs 38 that have the complementary features necessary to engage the upper compartment 24 of the channel 14, as well as mirror-image left and right sidewalls 40 that extend contiguously down and around into a bottom 42, completing the tubular shape of the body 30 and defining a cavity in the body 30.

The depending connecting legs 38 are spaced laterally outward from the sidewalls 40, giving the connecting legs 38 enough room to deflect inwardly in order to make a snug connection with the upper compartment 24 of the channel 14. The sidewalls 40 themselves are canted inward as they extend from top to bottom, leaving sufficient room for the connecting legs 38 to flex. The sidewalls 40 are at their narrowest at positions corresponding to the bottoms of the connecting legs 38. The profile of the body 30 then flares back out rectilinearly into the bottom 42, extending outward, down, and around.

As can be seen in both the exploded view of FIG. 2 and the cross-sectional view of FIG. 3, with the body 30 shaped and configured as it is, the light source 36 rests not on the cross-member 28 of the channel 14, as would be customary with a conventional linear luminaire, but along the interior bottom 42 of the body 30. This is part of what allows the light-generating assembly 12 to be a self-contained, sealed unit.

In this embodiment, the light source 36 is a strip of linear lighting, an elongate, narrow printed circuit board (PCB) 43 on which a number of LED light engines 44 are mounted, spaced apart at a regular spacing or pitch. Typically, a PCB 43 for linear lighting is of two-layer construction, with components surface-mounted on an upper layer and a lower layer that includes conductors. The LED light engines 44 may be of any type and produce any color or colors of light. In addition to the LED light engines 44, other components may be mounted on the PCB 43. These elements, such as resistors, may be used to control the current in the circuit or circuits and to control the LED light engines 44 themselves. The power cable 20 of the illustrated embodiment has two wires, usually a positive wire 48 and a negative-return wire 50, that are soldered to defined solder pads 52, 54 on the PCB 43. The PCB 43 itself may be either rigid or flexible, made, e.g., of a flexible material like polyimide film, polyethylene terephthalate (PET) film, or aramid film, or of a rigid material, like aluminum, FR4, or ceramic. With flexible material in particular, the PCB 44 may be made to arbitrary lengths, as lengths of flexible PCB material can be joined together at overlapping solder joints to form a PCB 43 of essentially any desired length.

The nature of the light source 36 is not critical. In addition to conventional linear lighting, organic LEDs (OLEDs), LED filaments, and other types of solid-state lighting may be used. As shown in FIG. 2, the light source 36 generally slides into the cavity within the body 30. This may be relatively easy to do if the light source 36 has a rigid PCB 43. However, the light source 36 may not always be a rigid strip. For example, the light source may also comprise a plurality of individual light-emitting elements that are connected together, e.g., a plurality of LED modules that are connected together by wires or cables. Moreover, although it is usually desirable for the light source 36 to extend substantially the entire length of the body 30 (e.g., less a small distance on each end used to seal the body 30), that is not an absolute requirement, and the precise arrangement of the light source 36 will usually depend on the application.

If the light source 36 is not in the form of a rigid strip (e.g., having a rigid PCB 43), it may be difficult to slide it into the body 30, at least in some circumstances, for example, if the body 30 is particularly long. There are many potential ways of dealing with this issue. For example, it may be helpful to join the PCB 43 to a carrier. A carrier, as the term is used here, means anything that can increase the stiffness of the PCB 44 enough to allow it to be inserted into the body 30 without difficulty, preferably without entirely compromising the flexibility of the PCB 43. Suitable carriers may include metal strips, like steel or aluminum strips, or plastic strips, typically thin and the same width or just wider than the PCB 43. If a carrier is used, the PCB 43 may be joined to the carrier with, e.g., pressure-sensitive adhesive on its underside. The carrier may or may not be adhered in place within the body 30. Typically, carrier-strips of this type are bendable in the same plane as the PCB 43. Other techniques may be used to get the light source 36 into the body. For example, a string may be tied or otherwise temporarily adhered to the PCB 43. In some cases, if the joint between the wires 48, 50 and the PCB 43 is strong enough, the power cable 20 may be used to pull the PCB 43 into the body 30.

The second, inner optical element 34 is an optional component. In some applications, the first, outer optical element 32 of the body 30 may be sufficient to perform the desired light manipulation. In that case, the second, inner optical element 34 may simply be omitted.

In this embodiment, the second, inner optical element 34 includes an optically-active portion 56, a leg 58 to each side of the optically-active portion 56, and an outwardly-extending support or lip 60 at the top of each leg 58. The arrangement is best seen in the cross-sectional view of FIG. 3: the lips 60 of the second, inner optical element 34 rest on ledges 62 defined in slot-spaces 64 that lie just under the first, outer optical element 32. From the lips 60, the legs 58 depend downwardly and slightly inwardly, such that when the light source 36 is installed, the optically-active portion 56 is centered directly over it. This overall arrangement allows the body 30 to include two optical elements 32, 56 when only one would typically be included, with the second, inner optical element 32 suspended from the body 30.

As may be apparent from FIG. 3, in the body 30 and second, inner optical element 34, portions that are not optically active (i.e., portions that are not designed to receive and transmit light) are opaque in this embodiment. Additionally, the channel 14, the body 30 and the second, inner optical element 34 have the same cross-sectional shape over their entire lengths. Because of this, the body 30 and the second, inner optical element 34 may be extruded, with co-extrusion used to extrude both the optically active and optically inactive parts at once. For example, co-extruded materials for body 30 could include material for the outer optical element 32 that is transparent with the balance of the material for the outer optical element being opaque. Exemplary transparent materials include acrylic, polycarbonate, or polyvinylchloride, although any material that is transparent to the light emitted by the linear lighting and has a higher index of refraction than air may be used. Non-optically active portions may be made of the same material with an added opaque colorant, or they may be made of a different material. A more detailed description of co-extruding an optical element can be found in the '170 patent.

While extrusion is one convenient way of making elements of constant cross-section, other methods of manufacture may also be used. For example, particularly in shorter sections, both the body 30 and the second, inner optical element 34 may be molded or co-molded, machined from a larger block of material, or made using additive manufacturing. It should also be understood that co-extrusion and co-molding are not the only possible techniques that could be used to create a piece with non-uniform properties. For example, an outer optical element could be extruded or molded of a single material and subjected to additional manufacturing operations to render non-optically active portions opaque, e.g., by coating. Additionally, dissimilar materials could be joined by processes like heat fusing, ultrasonic welding, or adhesives after initial manufacture.

Figure 4:
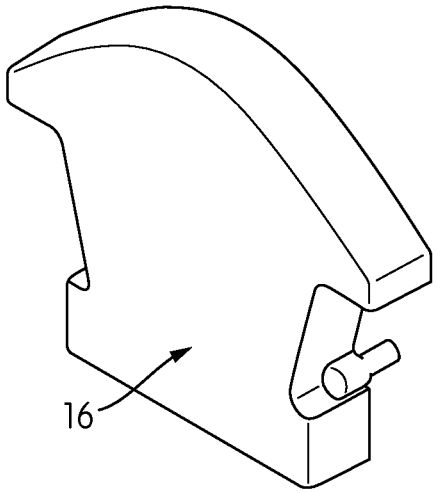
FIGS. 4-5 are front and back perspective views, respectively, of the solid endcap of FIG. 1.
Figure 5:
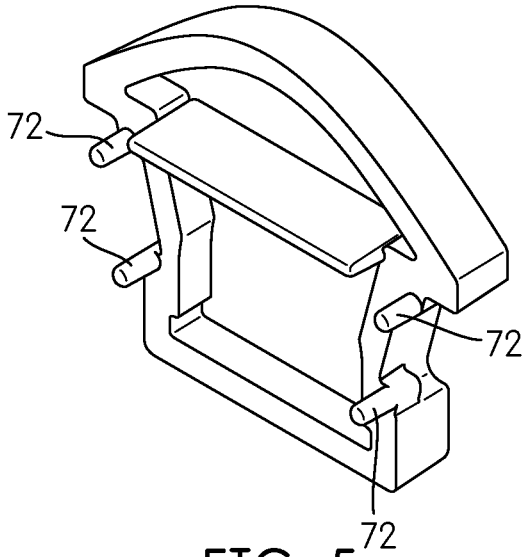
Figure 6:
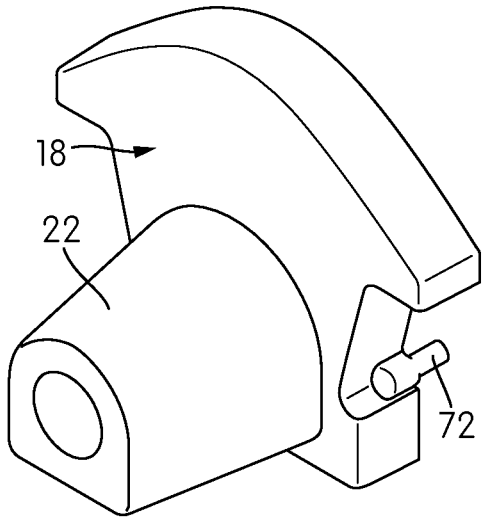
FIGS. 6-7 are front and back perspective views, respectively, of the endcap with a power cord opening of FIG. 1.
Figure 7:
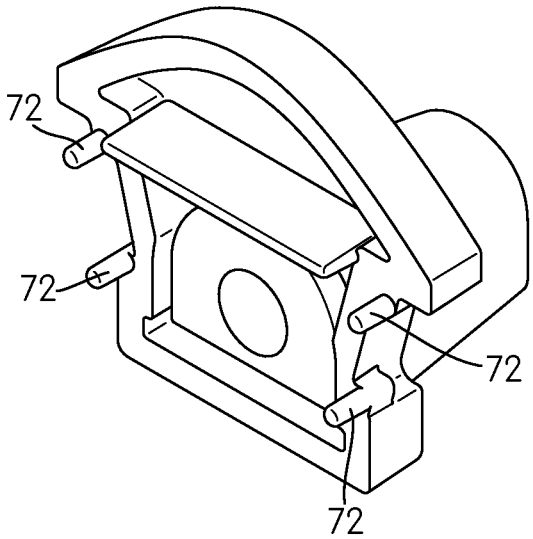

FIGS. 4-7 are outer and inner perspective views of the endcaps 16, 18, respectively. Specifically, the closed endcap 16 is shown in FIGS. 4-5 and the open endcap 18 is shown in FIGS. 6-7. Each endcap 16, 18 has the same set of engaging features that allow it to engage and seal an end of the body 30. Specifically, a set of four pins 72 project outwardly from each endcap 16, 18, such that they will extend into the body 30 when the endcaps 16, 18 are engaged with the body 30. The pins 72 are positioned such that they extend into the interstices of the body 30 (e.g., between the sidewalls 40 and the connecting legs 38. A wedge 74 projects from each endcap 16, 18 in the same direction as the pins 72. The wedge 74 may sit on the ledges 62 that support the second, inner optical element 34. In order to accommodate the endcaps 16, 18, the second, inner optical element 34 may have a length that is very slightly shorter than that of the body 30. Although the strain relief 22 is shown as a component of the endcap 18, it may be separate or attached to the power cord 20 in other embodiments.

The endcaps 16, 18 may be made of a compliant material, like a rubber, or of a hard plastic. If the endcaps 16, 18 are made of a hard plastic, they may have a co-molded or adhered layer of softer, compliant material in order to make a seal, or they may use an appropriately-shaped gasket between the inner face of the endcap 16, 18 and the outer face of the body 30, in order to make a better seal.

Figure 8:
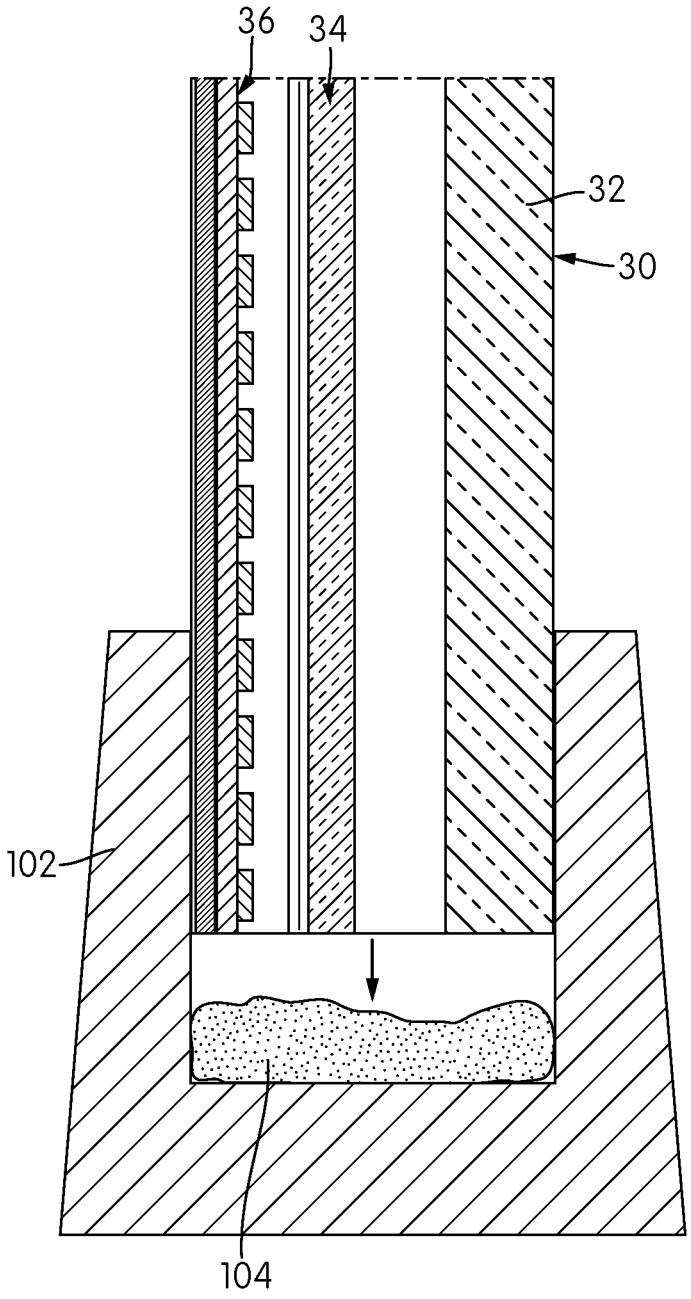
FIG. 8 is a cross-sectional view of the light-generating assembly of the linear luminaire of FIG. 1, illustrating its placement into a mold for end-sealing with a liquid resin.

Manufactured endcaps 16, 18 are not the only way to seal the body 30 of the linear luminaire 10. FIG. 8 is a cross-section of the body 30. In the view of FIG. 8, the body 30 is dipped end-first into a container 102 that contains a resin 104. The fit between the container 102 and the linear luminaire 100 is tight enough that the resin 104 will flow into and seal the end of the body 30 without flowing around it. The container 102 may have a shape that is a negative or mirror image of the outer perimeter of the body 30. A seal may be provided along the inner perimeter of the container or added to the exterior of the body 30 (e.g., by rolling a large O-ring or a custom-designed elastomeric piece onto the body 30). The end of the body 30 is dipped into the resin 104 to a shallow depth.

The resin would typically be a synthetic polymeric resin, e.g., a polyurethane resin, a silicone resin, a polyvinyl chloride (PVC) resin, or a resin of some other type of chemistry. The resin may be a one-component system that cures upon exposure, e.g., to air or to moisture in the air, or it may be a two-component system that cures after two components are mixed, e.g., a platinum- or tin-cured silicone resin system. Once the end of the body 30 is dipped, it may be clamped or held in place while curing occurs.

Figure 9:
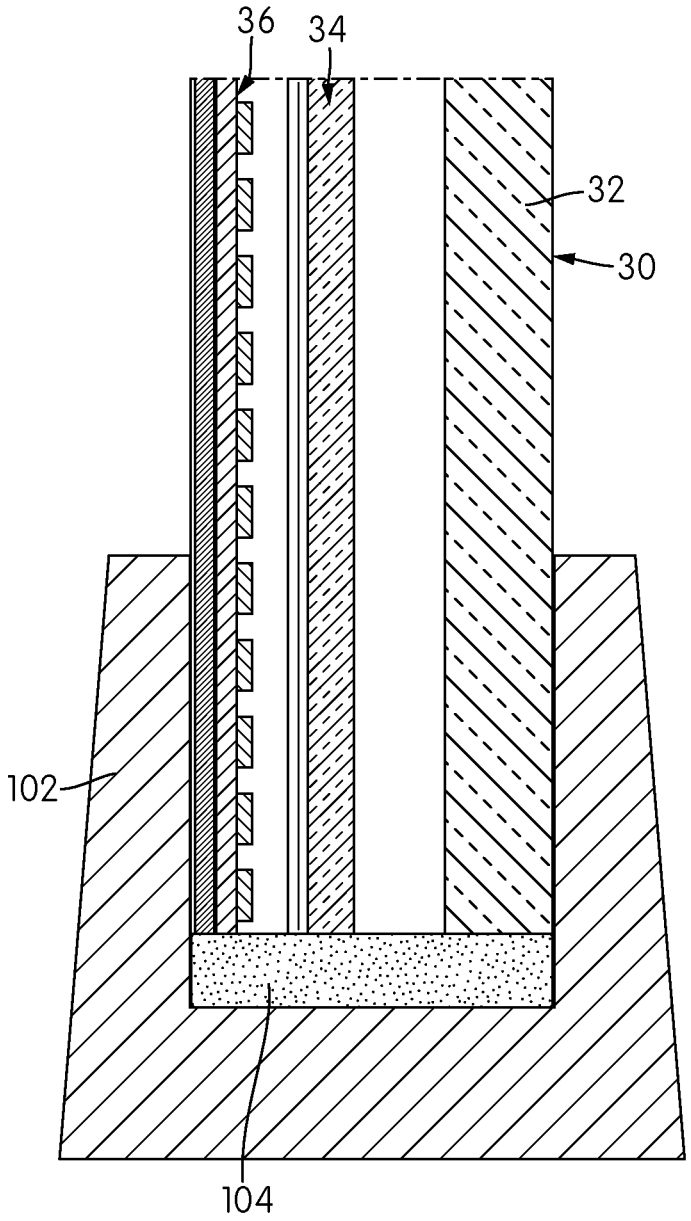
FIG. 9 is a cross-sectional view similar to the view of FIG. 8, illustrating the curing of a resin to seal the ends of the light-generating assembly.

The resin 104 may be caused or allowed to cure. That is, a mixed two-component resin system may cure by itself at room temperature (or at other ambient conditions), and any curing steps may simply involve allowing that to happen. Alternatively, a resin system may be caused to cure by, e.g., baking at elevated temperature (35° C., 65° C., etc.). In some cases, a resin system may also be cured by application of a form of radiation other than heat (e.g., UV light, or light of particular wavelengths). FIG. 9 is a cross-sectional view similar to the view of FIG. 8, illustrating the body with a solidified resin endcap 104.

Figure 10:
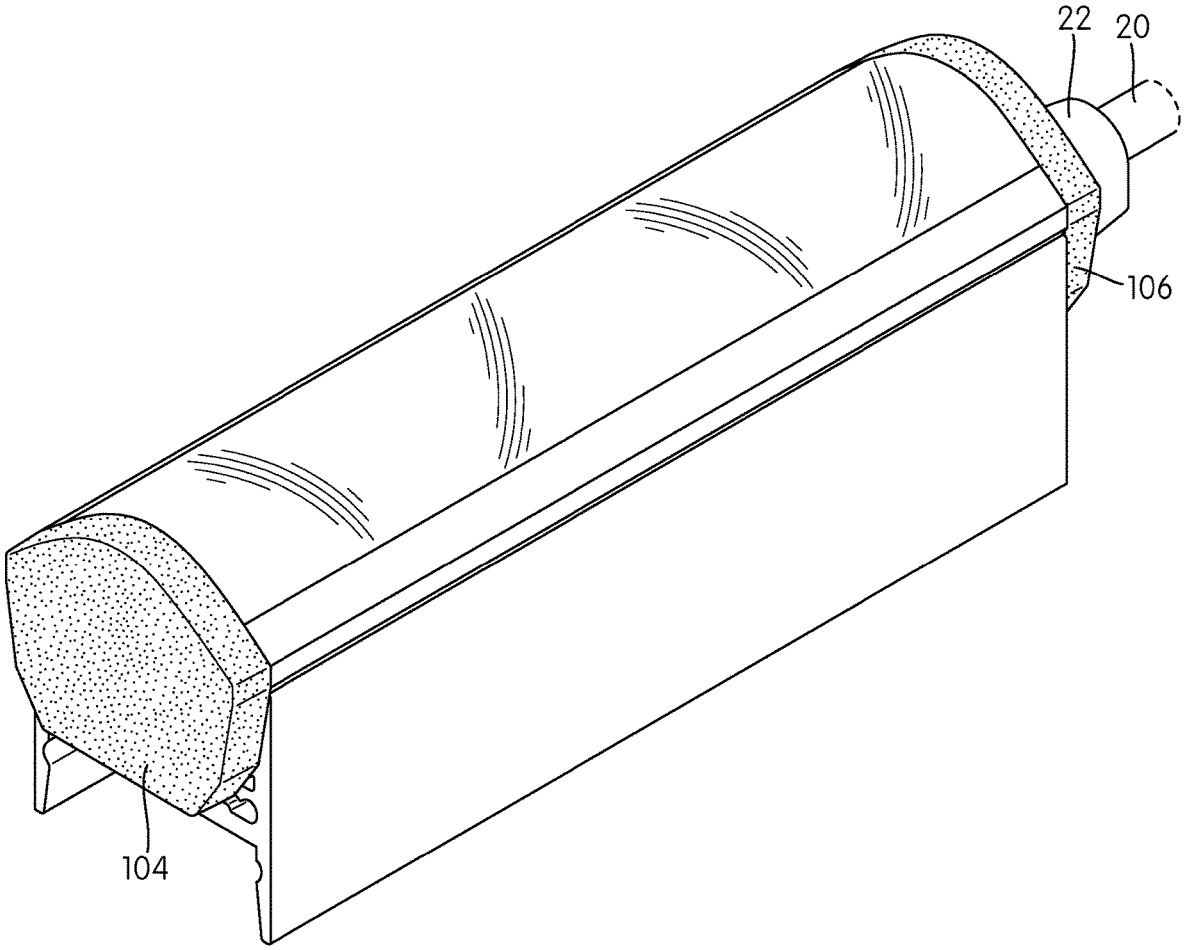
FIG. 10 is a front perspective view of the assembly of FIG. 9, sealed and installed in a channel.
Figure 11:
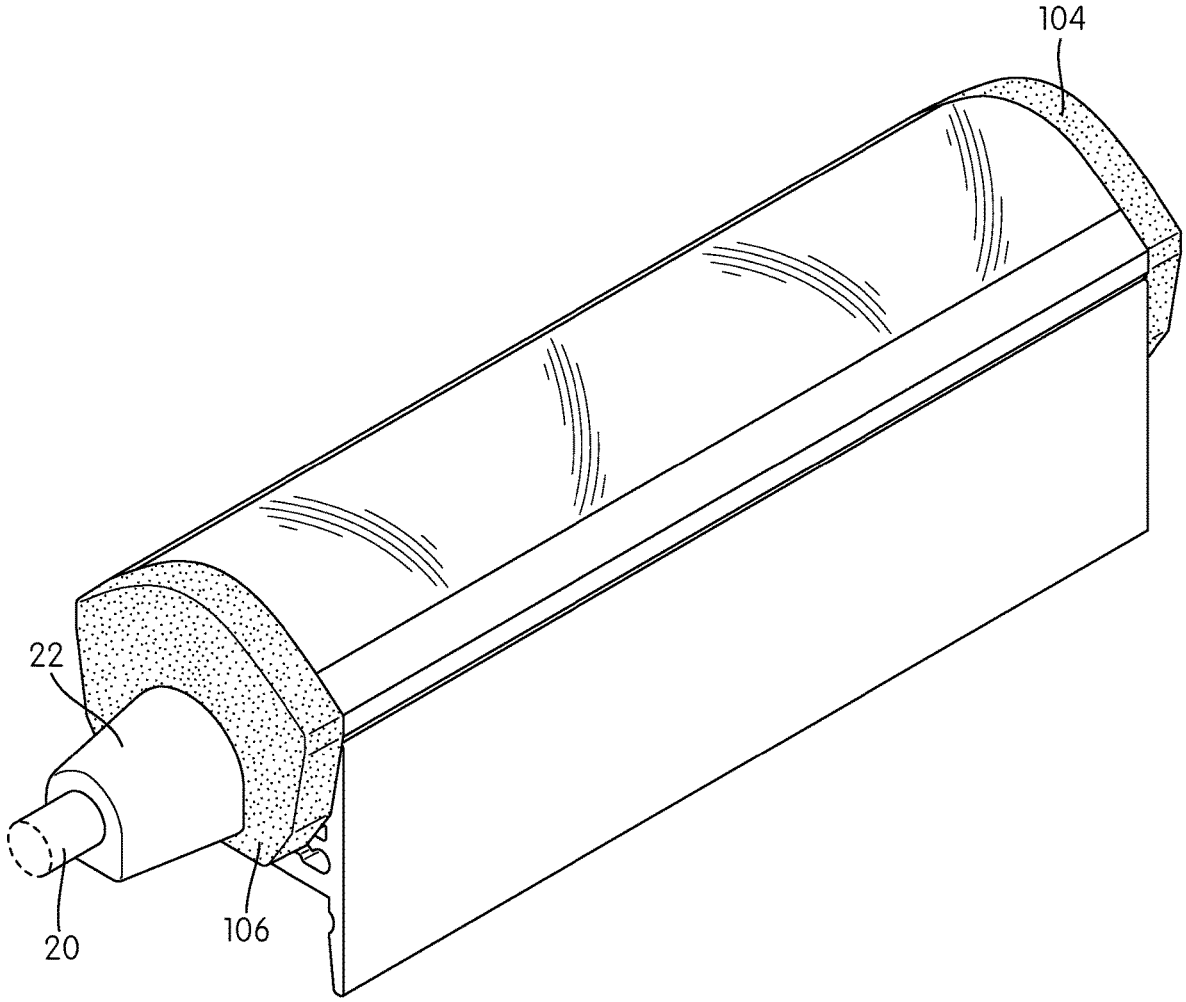
FIG. 11 is a rear perspective view of the assembly of FIG. 9, sealed and installed in a channel.

FIGS. 10 and 11 are left and right perspective views illustrating the linear luminaire 100 with its cured resin endcaps 104, 106. To make the endcap 106 with an opening for the power cord 20, an appropriate form or insert would be placed in position in the container 102.

The endcaps 104, 106 may or may not be removable, depending on the nature of the resin, the material of the channel 14, and other factors. For example, if the resin is a silicone and the channel 14 is made of metal, the endcaps 104, 106 may be removable, because the silicone would not typically adhere to the channel 14.

While the invention has been described with respect to certain embodiments, the description is intended to be exemplary, rather than limiting. Modifications and changes may be made within the scope of the invention, which is defined by the appended claims.

What is claimed is:

1. A closed optical assembly, comprising:

an elongate hollow body with an internal cavity, the elongate hollow body including a bottom, an outer optical element, and closed ends;

a light source positioned on the bottom of the elongate hollow body and within the internal cavity of the elongate hollow body;

an inner optical element having an optically-active portion and being positioned in the cavity of the elongate hollow body, between the light source and the outer optical element, to receive and transmit light emitted from the light source, the outer optical element being optically aligned with the optically-active portion of the inner optical element to receive and transmit light from the light source that has been transmitted by the optically-active portion of the inner optical element; and engaging structures provided on outer left and right sides of the elongate hollow body, the engaging structures being constructed and arranged to deflect inwardly, toward the body, and to press outwardly when deflected inwardly.

2. The closed optical assembly of claim 1, wherein the light source comprises a strip of linear lighting.

3. The closed optical assembly of claim 1, wherein the closed ends of the outer optical element comprise end caps adapted to seal the cavity of the elongate hollow body.

4. The closed optical assembly of claim 1, wherein the elongate hollow body defines a set of ledges within the cavity of the elongate hollow body and the inner optical element includes structure that rests on and depends downwardly from the ledges to support the optically-active portion of the inner optical element below the outer optical element.

5. The closed optical assembly of claim 1, wherein portions of the hollow body other than the outer optical element are at least substantially opaque.

6. A linear luminaire comprising:

a channel including a pair of sidewalls and a cross-member extending between and connecting the sidewalls; and a closed optical assembly disposed within and supported by the channel, the closed optical assembly including an elongate hollow body with an internal cavity, the elongate hollow body including a bottom, an outer optical element, and closed ends, a light source positioned on the bottom of the elongate hollow body and within the internal cavity of the elongate hollow body, the light source being spaced from the cross-member of the channel, and an inner optical element having an optically-active portion and being positioned in the cavity of the elongate hollow body, between the light source and the outer optical element, to receive and transmit light emitted from the lighting light source, the outer optical element being optically aligned with the optically-active portion of the inner optical element to receive and transmit light from the light source that has been transmitted by the inner optical element.

7. The linear luminaire of claim 6, wherein the channel has a generally H-shaped cross section, such that the cross-member divides the channel between an upper compartment adapted to house the closed optical assembly and a lower compartment.

8. The linear luminaire of claim 6, wherein inner faces of the pair of sidewalls have an engaging profile that engages the closed optical assembly.

9. The linear luminaire of claim 8, further comprising engaging structures provided on outer left and right sides of the body of the closed optical assembly, the engaging structures having profiles complementary to the engaging profiles of the pair of sidewalls.

10. The linear luminaire of claim 9, wherein the engaging structures are constructed and arranged to deflect inwardly, toward the body, and to press outwardly on the pair of sidewalls.

11. The linear luminaire of claim 6, wherein the light source comprises a strip of linear lighting.

12. The linear luminaire of claim 6, wherein the closed ends of the outer optical element comprise end caps adapted to seal the cavity of the elongate hollow body.

13. The linear luminaire of claim 6, wherein the elongate hollow body defines a set of ledges within the cavity of the elongate hollow body and the inner optical element includes structure that rests on and depends downwardly from the ledges to support the optically-active portion of the inner optical element below the outer optical element.

14. The linear luminaire of claim 6, wherein portions of the hollow body other than the outer optical element are at least substantially opaque.

15. A method of producing a sealed optical assembly, comprising:

providing an optical assembly including an elongate hollow body with an internal cavity, the elongate hollow body including a bottom, an outer optical element, and closed ends; a light source positioned on the bottom of the elongate hollow body within the internal cavity of the body; and an inner optical element positioned in the cavity of the elongate hollow body, between the light source and the outer optical element, to receive and transmit light emitted from the light source, wherein the outer optical element is optically aligned with the inner optical element to receive light from the light source that has been transmitted by the inner optical element;

dipping an unsealed end of the optical assembly into a container having a supply of uncured resin such that the uncured resin covers and surrounds the unsealed end of the optical assembly; and causing or allowing the resin to cure, with the unsealed end of the optical assembly disposed in the supply of uncured resin, so as to seal the unsealed end of the optical assembly.

* * * * *